United States Patent [19]

Fujihira

[11] Patent Number: 4,911,567

[45] Date of Patent: Mar. 27, 1990

[54] PRINT HEAD PRESS-CONTACT DEVICE

[75] Inventor: Hajime Fujihira, Tokyo, Japan

[73] Assignee: Seiko Instruments Inc., Tokyo, Japan

[21] Appl. No.: 215,730

[22] Filed: Jul. 6, 1988

[30] Foreign Application Priority Data

Jul. 6, 1987 [JP] Japan ..... 62-103443[U]

[51] Int. Cl.[4] ..... B41J 25/28; B41J 3/20

[52] U.S. Cl. ..... 400/120; 400/328

[58] Field of Search ..... 101/291, 292, 297, 298, 101/316; 400/161, 328, 120

[56] References Cited

U.S. PATENT DOCUMENTS

| | | | |
|---|---|---|---|
| 1,005,367 | 10/1911 | Trasue | 101/297 |
| 3,881,587 | 5/1975 | Okabe | 400/161 X |
| 3,945,481 | 3/1976 | Lindberg | 400/328 |
| 4,507,666 | 3/1985 | Kondo et al. | 346/76 PH |

FOREIGN PATENT DOCUMENTS

| | | | |
|---|---|---|---|
| 151081 | 8/1985 | Japan | 400/120 |
| 274974 | 12/1986 | Japan | 400/120 |
| 83166 | 4/1987 | Japan | 400/120 |

*Primary Examiner*—Clifford D. Crowder

*Attorney, Agent, or Firm*—Spensley Horn Jubas & Lubitz

[57] ABSTRACT

A print head press-contact device for a printer, arranged such that a print head holder is rotatably attached to a head press-contact lever, and the head press-contact lever is rotatably attached to a head carrier. The print head is thus installed in the head carrier through a plurality of pivots, such that the print head can follow a hard print material which may not evenly contact the flat face of a platen.

5 Claims, 2 Drawing Sheets

PRINT HEAD PRESS-CONTACT DEVICE

BACKGROUND OF THE INVENTION

1. Field of the Invention

This invention relates to a device for bringing a print head to a printer into a press-contact state with print material.

2. Description of the Prior Art

It is well known that a printer that prints a tag or label (or the like) by pressing it against a print head often has uneven contact between the print head and the print material which causes the print to blur. This is due to the fact that no uniform pressure is applied over the entire surface of the print material. Even if a print head is initially designed not to blur when printing, mechanical displacement takes place in the printer as time lapses, causing uneven contact. In order to solve this problem, Nozaki et al. (Japanese Laid-Open utility model No. 51-154211) discloses a print head press-contact device having a platen which is rotatably held with respect to the printer frame, whereby the platen and print head are brought into close-contact with each other. As the platen rotates and oscillates elastically with respect to the surface of the print head while it presses a tag or label against the print head, a substantially uniform pressure is applied to the print material so that no printing blur occurs.

However, when the print material is so hard or stiff that it does not closely contact the platen, rotating the platen does not produce a close-contact between the print head and the print material, and hence sufficient contact therebetween cannot be obtained. It is therefore difficult to obtain high print quality when hard print materials are used.

SUMMARY OF THE INVENTION

Thus, a principal object of the present invention is to provide a print head press-contact device capable of following the printing surface of a print material.

Another object of the present invention is to provide a print head press-contact device capable of producing good printing quality even when printing on hard or stiff print materials.

Still another object of the present invention is to provide a print head press-contact device capable of reducing the costs of manufacture by eliminating an adjustable rotating unit for the platen.

These and other objects of the invention are accomplished by a print head press-contact device arranged such that a print head holder is rotatably attached to a head press-contact lever, and the head press-contact lever is rotatably attached to a head carrier. The print head is thus installed in the head carrier through a set of pivots, such that the print head can follow a hard print material which may not evenly contact the flat face of a platen.

The above and other related objects and features of the invention will be apparent from a reading of the following description of the disclosure in conjunction with the accompanying drawings and the novelty thereof pointed out in the appended claim.

BRIEF DESCRIPTION OF THE DRAWINGS

The present invention will be explained in more detail with reference to the accompanying drawings wherein.

Like numbers in the various drawings refer to like elements.

DETAILED DESCRIPTION OF THE INVENTION

Figure 1:
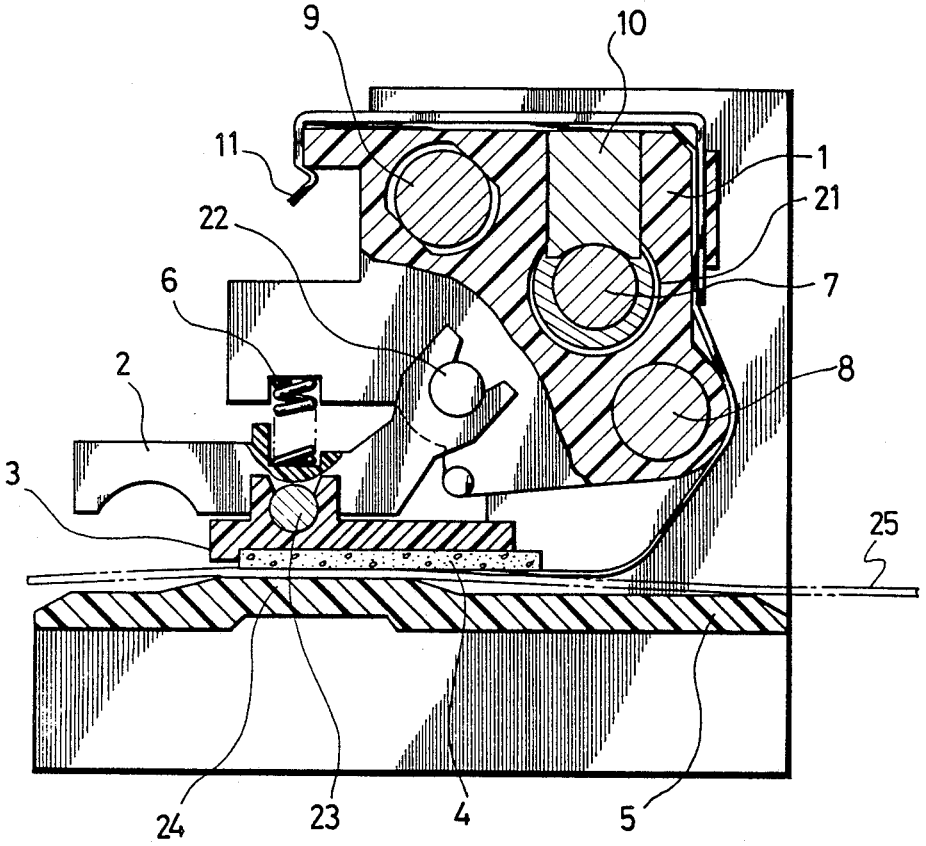
FIG. 1 is a sectional view of an embodiment of a printer in accordance with the present invention.
Figure 2:
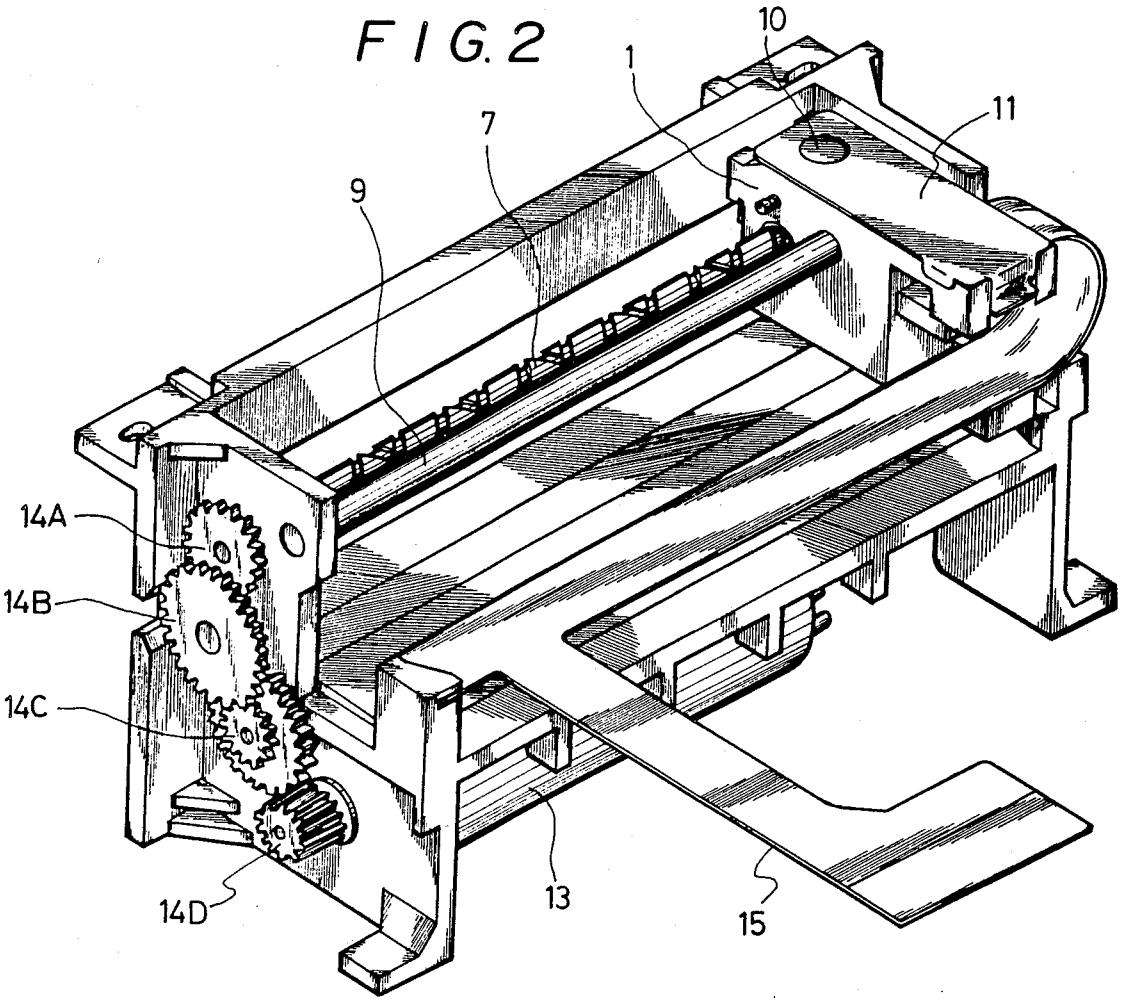
FIG. 2 is a perspective view of a printer in accordance with the present invention.

FIG. 1 and FIG. 2 respectively show a sectional view and a perspective view of a printer in accordance with the present invention. A head carrier 1 has head carrier guide spindles 8 and 9 penetrating respective lateral holes which are formed in the head carrier 1 and which are disposed apart from each other. The head carrier 1 moves side-to-side in the printer while being guided by the two head carrier guide spindles 8, 9. A head carrier transfer spindle 7 penetrates, in a non-contact manner, a lateral hole 21 formed in the head carrier 1. A head carrier driving pin 10 supported with a stopper 11 on the head carrier 1 engages a spiral recess on the head carrier transfer spindle 7. The stopper 11 prevents the head carrier driving pin 10 from detaching from the head carrier transfer spindle 7.

The rotation of a motor 13 is transferred through reduction gears 14A, 14B, 14C and 14D to the head carrier transfer spindle 7. By the rotation of the head carrier transfer spindle 7, the head carrier 1, by means of the head carrier driving pin 10 engaged with the helical groove provided on the head carrier transfer spindle 7, shifts in the longitudinal direction along the head carrier transfer spindle 7.

A head press-contact lever 2 is rotatably attached to a lever spindle 22 fitted to the head carrier 1, while a head holder 3 is rotatably attached to a head spindle 23 fitted to the head press-contact lever 2. A print head 4 is adhesively bonded to the head holder 3. A spring 6 is fitted at one end in a groove provided in the head carrier 1 and at its opposing end in a groove provided on the top side of the head press-contact lever 2. The spring 6 provides, through the head press-contact lever 2, a downward pressure to the print head 4 bonded to the head holder 3 against a platen 24.

The platen 24 is formed from the face of a frame 5. Print material 25 can be placed on the platen 24. The cross-section of the platen 24 has, at the printing section, a flat face protruding from its surrounding surface such that the flat face comes in contact with the print head 4. This feature facilitates easy contact between the print head 4 and the print material 25 placed within the printing section.

If a hard or stiff print material 25 is inserted into the printing section of a printer made in accordance with the present invention, the print material may be set angled with respect to the protruding flat face of the platen 24, and may not evenly contact the flat face. In such a case, the hard print material 25 pushes up the print head 4, causing the head press-contact lever 2 to rotate around the lever spindle 22, and the print head 4 to rotate around the head spindle 23, thereby automatically adjusting the angle of the print head 4 to the corresponding angle of the hard print material 25. The spring 6 maintains the print head 4 in good press-contact with the print material 25.

In summary, the print head 4 automatically adjusts its position and angle in response to the angle of the hard print material 25, making close contact with the print material 25.

If a print material has undulations along its width, the head press-contact lever 2 and the head holder 3 rotatably move around the lever spindle 22 and the head spindle 23 respectively as the head carrier travels, thereby permitting the print head 4 to shift and remain in contact with the print material surface along the entire width of the print material.

As described above, a printer according to the present invention may be used not only with ordinary print media, but also with hard or stiff print material because its print head follows any tilt angles of the print media and therefore comes in good contact with it, thereby producing high quality print output.

Although the present invention has been described in connection with a particular embodiment thereof, additional embodiments, applications and modifications, which will be obvious to those skilled in the art, are included within the spirit and scope of the invention. Therefore, this invention is not to be limited to the specific embodiment discussed and illustrated herein, but rather by the following claim.

I claim:

1. A print head press-contact device comprising:

(A) a printer frame;

(B) a rotatable head carrier transfer spindle provided on the printer frame;

(C) a head carrier having a means for engaging the head carrier transfer spindle, and the head carrier being movable along the head carrier transfer spindle when the head carrier transfer spindle rotates;

(D) a head press-contact lever;

(E) first pivot means coupled between the head carrier and the lever for permitting the lever to pivot relative to the head carrier;

(F) a spring connected at one end to the head carrier and at its opposing end to the head press-contact lever, for providing a pressure to the head press-contact lever;

(G) a head holder for holding a print head thereon;

(H) second pivot means coupled between the head press-contact lever and the head holder for permitting the head holder to pivot relative to the lever; and (I) a platen attached to the printer frame, for holding a material to be printed, and positioned adjacent to the head holder and along the path of movement of the head carrier; wherein the head press-contact lever rotates with respect to the first pivot means for pressing the print head against a material held by the platen by the pressure of said spring, and the head holder rotates with respect to the second pivot means so that the surface of the print head contacts with the material held by the platen.

2. A device as defined in claim 1 wherein the head holder comprises means for supporting the print head for permitting pivotal movement of the print head relative to the press-contact lever.

3. A device as defined in claim 2 wherein each pivot means has an axis and the axis of the two pivot means extend substantially parallel to one another.

4. A device as defined in claim 1 wherein each pivot means has an axis and the axis of the two pivot means extend substantially parallel to one another.

5. A print head press-contact device comprising:

(A) a printer frame;

(B) a rotatable head carrier transfer spindle provided on the printer frame;

(C) a head carrier having a means for engaging the head carrier transfer spindle, and the head carrier being movable along the head carrier transfer spindle when the head carrier transfer spindle rotates;

(D) a first spindle fitted to the head carrier;

(E) a head press-contact lever rotatably attached to the first spindle;

(F) a spring connected at one end to the head carrier and at its opposing end to the head press-contact lever, for providing a pressure to the head press-contact lever;

(G) a second spindle fitted to the head press-contact lever;

(H) a head holder rotatably attached to the second spindle, for holding a print head thereon; and (I) a platen attached to the printer frame, for holding a material to be printed, and positioned adjacent to the head holder and along the path of movement of the head carrier; wherein the head press-contact lever rotates with respect to the first spindle for pressing the print head against a material held by the platen by the pressure of said spring, and the head holder rotates with respect to the second spindle so that the surface of the print head contacts with the material held by the platen.

* * * * *